US005588805A

United States Patent [19]

Geringer

[11] Patent Number: 5,588,805

[45] Date of Patent: Dec. 31, 1996

[54] VIBRATION AND PRESSURE ATTENUATOR FOR HYDRAULIC UNITS

[75] Inventor: Kerry G. Geringer, Ames, Iowa

[73] Assignee: Sauer Inc., Ames, Iowa

[21] Appl. No.: 520,083

[22] Filed: Aug. 28, 1995

[51] Int. Cl.[6] ..... F04B 1/26

[52] U.S. Cl. ..... 417/53; 417/222.1

[58] Field of Search ..... 417/218, 222.1, 417/53; 60/469

[56] References Cited

U.S. PATENT DOCUMENTS

| | | | |
|---|---|---|---|
| 3,612,724 | 10/1971 | Smith | 417/222 |
| 3,826,593 | 7/1974 | Von Casimir | 417/53 |
| 4,234,292 | 11/1980 | Berg | 417/218 |
| 4,456,434 | 6/1984 | El Ibiary | 417/218 |
| 4,734,011 | 3/1988 | Hall, Jr. | 417/2 |
| 5,475,976 | 12/1995 | Phillips | 60/469 |

*Primary Examiner*—Timothy S. Thorpe
*Assistant Examiner*—Peter G. Korytnyk
*Attorney, Agent, or Firm*—Zarley, McKee, Thomte, Voorhees, & Sease

[57] ABSTRACT

An attenuator for a variable displacement hydraulic unit having a servo connected to a swashplate includes an oscillator connected to the servo. The oscillator includes a pipe constituting an inertial portion connected to the servo and a hose defining a hydraulic spring portion connected the other end of the pipe. The pipe has a fixed length and diameter. The pipe and hose combine to attenuate vibration and output pressure in the hydraulic unit by introducing a phase change in the pressure fluctuations within the fluid. A linearized model assists in sizing the components and tuning the oscillator to the troublesome frequency of the hydraulic unit. A method for using the oscillator to attenuate periodic pressure fluctuations due to swashplate vibrations includes fluidly connecting the oscillator to the servo piston bore and introducing a phase change to the periodic component of the fluid pressure by routing the fluid through the oscillator then returning it to the servo piston bore.

12 Claims, 8 Drawing Sheets

VIBRATION AND PRESSURE ATTENUATOR FOR HYDRAULIC UNITS

BACKGROUND OF THE INVENTION

The present invention relates to the field of hydraulic units, including pumps and motors. In particular, this invention relates to a device for attenuating vibration and periodic pressure fluctuations in hydraulic units having variable displacement controlled by a servo system which is hydraulically coupled to the periodic portion of the output pressure of the unit. The device is particularly useful on axial piston units.

Vibrations and pressure fluctuations are commonplace in hydraulically operated equipment. However, end users are becoming increasingly concerned about and intolerant of the contribution of hydraulic units to the overall levels of vibration, pressure fluctuation and noise on their machines. Heretofore it has been difficult to significantly reduce the pressure fluctuations and vibrations in hydraulic units, particularly in axial piston pumps and motors where a portion of the output power (in terms of flow and pressure) is used as a power supply for a control system utilizing one or more servo pistons to vary displacement. High levels of vibration and pressure fluctuation result from the unsteady component of the output pressure which is periodic in nature. This unsteady component of the output pressure is typically present and is seen at the piston frequency and may include one or more harmonics of this frequency. High levels of vibration and pressure may also occur if a separate power supply for the control system is dynamically coupled to the output characteristic of the hydraulic unit.

The unsteady pressure of the supply oil that reaches the servo causes the swashplate to oscillate at the primary forcing (piston) frequency. Swashplate oscillations will affect the unsteady or periodic component of the output pressure in a closed feedback loop. A resonant condition will develop if the gain of the closed feedback loop is sufficiently high and the phase relationship is shifted 180 degrees from the ideal; the amplitude of the oscillations grows to a significant value.

The resonant frequency is a function of the geometry of the porting and the compression/decompression dynamics of the pistons in the hydraulic unit. Additionally, there are transport lags due to the time it takes for the signal to reach the control valve. An additional phase lag takes place as a result of the restriction of the control valve and the volume of the servo piston.

Therefore, a primary objective of the present invention is the provision of an apparatus for attenuating pressure fluctuations and vibrations in hydraulic units. To attenuate something is defined as reducing its intensity.

Another objective of this invention is the provision of an apparatus for attenuating pressure fluctuations and vibrations in axial piston pumps and motors where the output power is used as a power supply for the control system or a separate power supply is dynamically coupled with the control system.

Another objective of this invention is the provision of an apparatus for attenuating pressure fluctuations and vibrations that can be used to retrofit existing hydraulic units.

Another objective of this invention is the provision of an attenuator that is economical to manufacture and durable in use.

These and other objectives will be apparent to one skilled in the art from the description which follows.

SUMMARY OF THE INVENTION

The present invention is a vibration and pressure attenuator for a variable displacement hydraulic unit having a movable displacement varying means controlled by a servo mechanism. The attenuator includes an oscillator means, which has a inertial pipe or tube portion and a compliant portion or hydraulic spring portion comprising a hose. The pipe or tube is connected to the servo mechanism and the hose is connected to the other end of the pipe. The pipe is long and slender with a fixed length and diameter. Its high length over diameter ratio allows the fluid mass to be the predominate property within the pipe. On the other hand, the hose has a relatively large diameter which results in an relatively substantial internal volume such that the compressibility of the fluid is the predominate property within the hose, making it act as a hydraulic spring. By utilizing the linear model disclosed below, the above pipe and hose parameters can be set or chosen so as to attenuate vibration and output pressure in the hydraulic unit at a particular troublesome frequency. The model of this invention also provides insights into the effects of other circuit parameters on the swashplate vibration problem.

The attenuator of this invention can be applied to the servo of variable pumps and variable motors in open or closed circuits.

DETAILED DESCRIPTION OF THE PREFERRED EMBODIMENT

Figure 1:
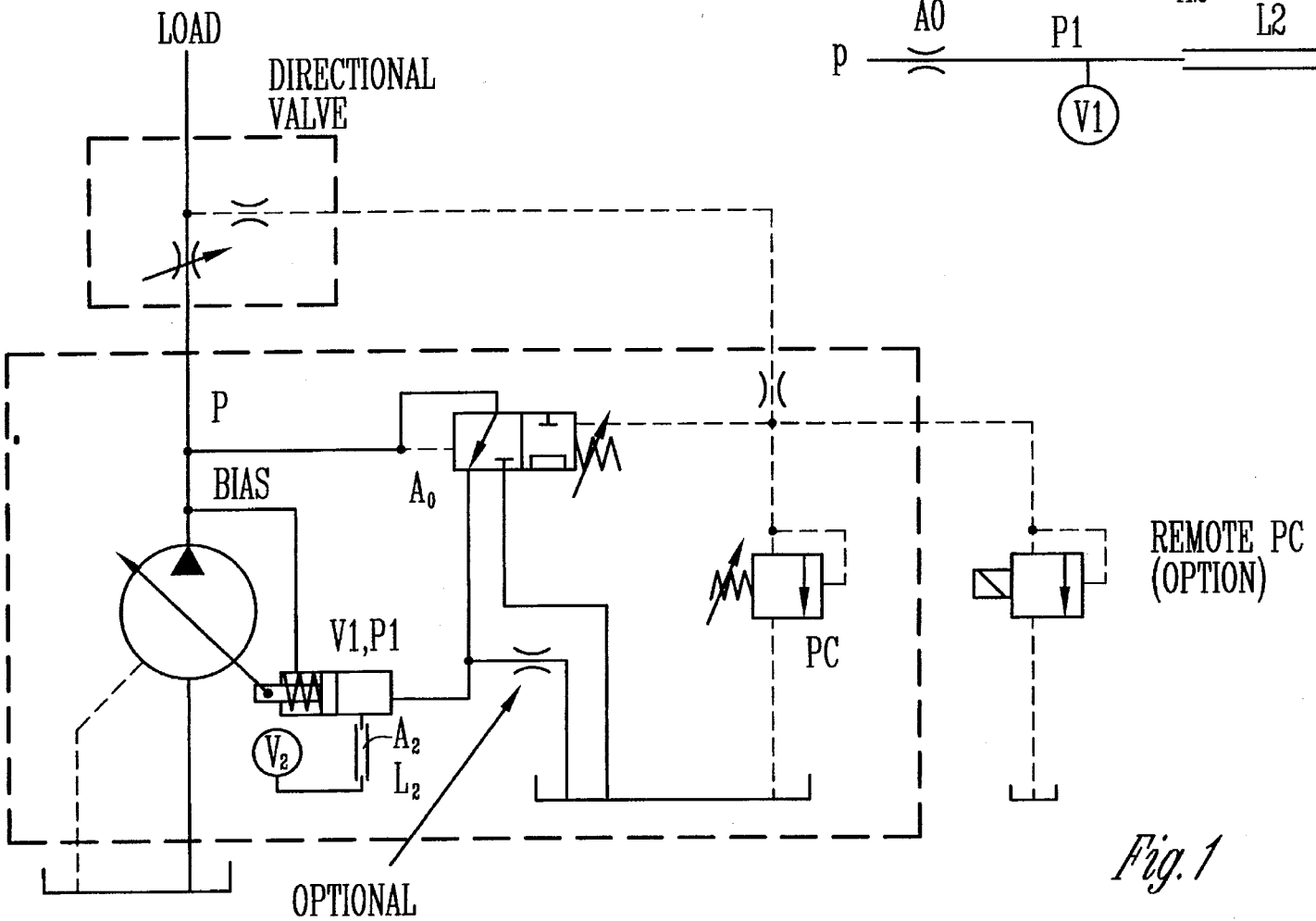
FIG. 1 is a hydraulic schematic of an open-circuit hydraulic unit equipped with the present invention.

FIG. 1 depicts a hydraulic system comprising an open circuit hydrostatic axial piston pump 10 with a load sensing/pressure compensating control. The pump 10 includes a movable swashplate 12 for varying the fluid displacement of the pump 10. Conventionally, the pump has a suction inlet line 14 that draws fluid from a reservoir 16 to which any internal leakage present in the casing of the pump is routed via a case drain line 18. When the swashplate 12 is tilted away from a perpendicular position with respect to the axial pistons, the pump 10 generates an output flow and pressure P. P is commonly referred to by those in the art as supply pressure or output pressure.

The output pressure P is connected to a servo mechanism or servo piston assembly 20 having a piston assembly 22 operatively disposed in a cylinder 24. The piston assembly 22 includes a piston 26 with a rod 28 attached. The free end of the rod 28 is connected to the swashplate 12. A spring 30 urges the piston assembly 22 toward one end of the cylinder 24 in the absence of hydraulic forces. In addition, the output pressure P of the pump 10 is fluidly connected with the end of the servo piston assembly 20 where the spring 30 is located. Thus, mechanically and hydraulically, the servo piston assembly 20 is normally biased toward the right in FIG. 1 or full displacement.

The foregoing structure is conventional in existing hydraulic units. One skilled in the art will understand that the schematic hydraulic diagram of FIG. 1 is merely a convenient symbolic representation of the actual hardware in the circuit. The actual hardware may differ somewhat in number, form and physical arrangement without departing from the scope of the invention or the function symbolically represented. For instance, a biasing servo piston and a stroking servo piston may cooperate to constitute the functional equivalent of the single servo piston symbolically represented in FIG. 1.

The output pressure is also fluidly connected to an adjustable two-position displacement control valve 32 and supplied to a load 34 via a control valve 36. The control valve 36 may be simply represented as a variable orifice 38. Pressure at the load 34 is monitored and compensated for through a pilot pressure line 40 having orifices 42 and 44 therein. Furthermore, the line 40 connects a pressure compensating adjustable pilot valve 46 with the two-position displacement control valve 32 as shown in FIG. 1 to provide pressure compensation for the control valve 32. Control valve 32 is also referred to as a main stage valve. Excess pressure is bled off by the pilot valve 46 to a suitable drain reservoir 48, such as the pump case.

The control 32 has three ports: the first port is connected to the pump case 48, the second port is connected to the servo piston assembly 20 at the end opposite the spring 30, and the third port is connected to the pump outlet pressure or supply pressure P. When the control valve 32 is positioned as shown in FIG. 1, a signal pressure P1 indicative of outlet pressure P is supplied to the end of the servo piston assembly 20. In operation, the spool of the main stage valve 32 modulates and acts as a restriction of area AO. P1 opposes the biasing force of the spring 30 and the hydraulic bias discussed above. Increasing the pressure P1 tends to reduce the angle of the swashplate 12 and thereby the displacement of the pump 10. At any given time, the right end of the cylinder 24 of the servo piston assembly 20 has a volume V1 of fluid, such as oil, at a pressure P1. P1 is commonly referred to as servo pressure in the art.

In its other position the control valve 32 interconnects the servo piston assembly 20 with the pump case 48. In this position the right end of the servo piston assembly 20 is drained so that the pump 10 is destroked to neutral where it has zero displacement.

The servo piston assembly 20 further includes an oscillator means 50 fluidly connected to the volume V1 at the right end of the cylinder 24. The oscillator means 50 has an internal pipe portion 52 with one end fluidly connected to the volume V1 of the servo cylinder 24 another end connected to a compliant portion 54. The inertial pipe portion 52 is preferably a long, slender and rigid tube. The tube or pipe 52 has a length L2 and an inside diameter D2 that defines a cross sectional area A2. A preferably circular cross section pipe with a high length-over-diameter (L/D) ratio, for instance greater than 20:1 or 20 and particularly 38 approximately, produces good attenuation.

Those skilled in the art will appreciate that the pipe 52 can be constructed with other types of cross sections without departing from the spirit of the present invention. The long slender shape and rigid nature of the inertial pipe portion 52 allow the fluid mass or inertia to be the predominate property in this section of the flow path.

The compliant portion 54 of the oscillator means 50 is also referred to herein as the hydraulic spring portion and comprises an elongated hose having a preferably circular cross sectional area A3 and volume V3 based on an inside diameter D3 which is typically larger than the diameter D2 of the inertial pipe portion 52. The hose 54 also has a length L3 and a volume V3. The hose or hydraulic spring portion 54 is so named because the fluid compressibility is the predominate property therein. The fluid in the hose acts as a hydraulic spring while the fluid in the pipe acts like a mass acting against the hydraulic spring. One skilled in the art will appreciate that the hydraulic spring action can come from at least two sources: the compressibility of the oil and the flexibility of the hose. Preferably the hydraulic spring portion volume V3 is approximately one cubic inch.

Thus, the compliant portion 54 of the oscillator means 50 provides a section of the fluid flow path wherein fluid compressibility is the predominate property and the inertial pipe portion 52 provides a section wherein the fluid mass is the predominate property. Together the portions 52 and 54 form a simple hydraulic oscillator means 50 which, when added in the proper way to the servo mechanism 20, changes the phase relationship between the outlet pressure P and the servo pressure P1. The oscillator 50 adds a second order lead to the servo pressure dynamics. The oscillator frequency is determined by sizing the parameters of its portions 52 and 54, namely L2, D2, and V3. When the components of the oscillator 50 are properly sized, the oscillator frequency lies at or is tuned to the resonant frequency wherein the problem resides.

Figure 2:
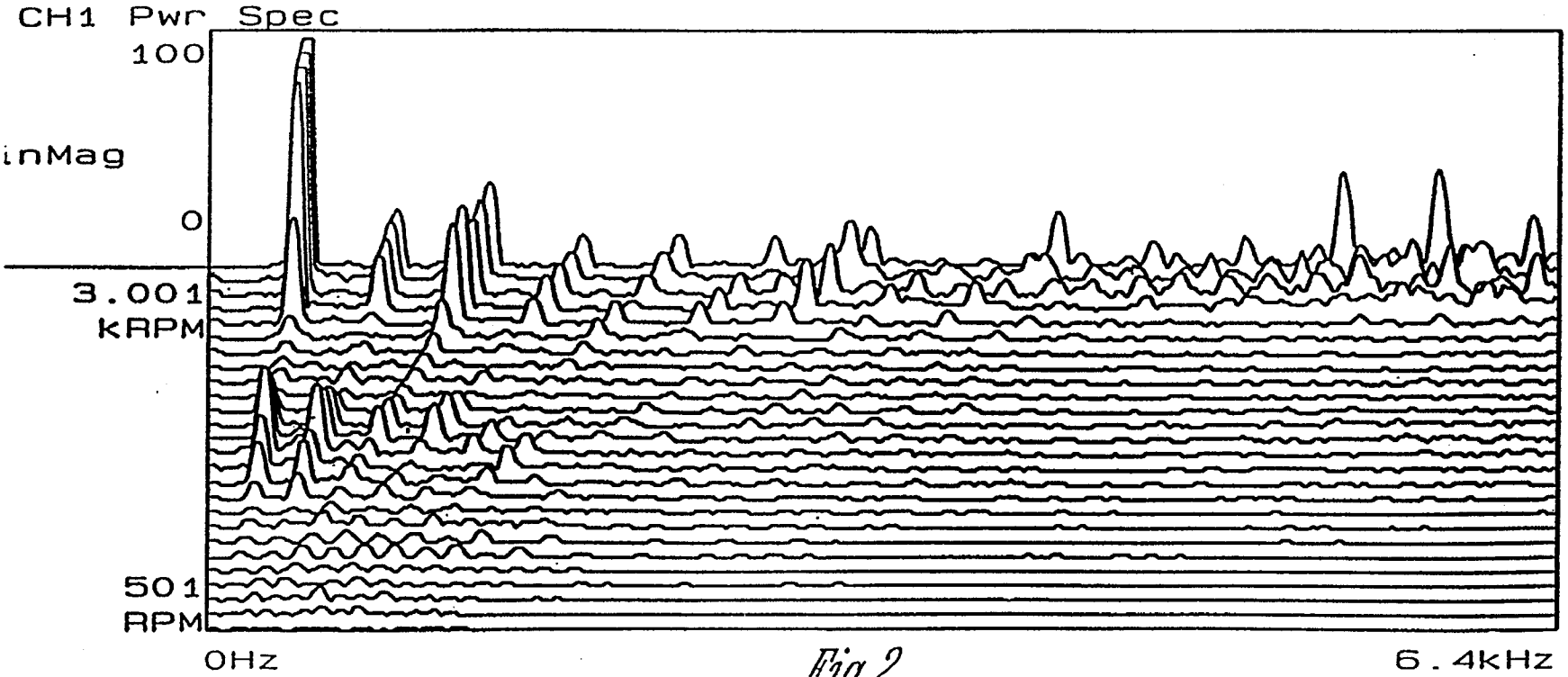
FIG. 2 is a plot showing the swashplate vibrations (acceleration levels in g's) in an open circuit axial piston hydraulic pump before it is equipped with the attenuator of the present invention.
Figure 2A:
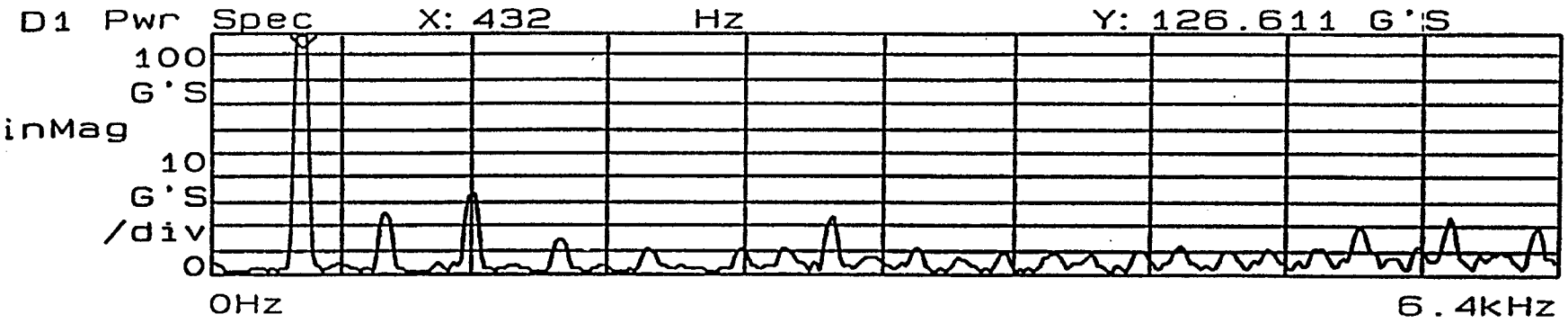
FIG. 2A corresponds to FIG. 2 and is a plot showing the frequency in hertz versus the acceleration amplitude in g's of the vibrations when the pump is run at 2800 rpm.

The advantages of the present invention can best be understood by comparing the swashplate vibrations in a standard hydraulic unit with those in a unit equipped with the attenuator of this invention. FIG. 2 is a set of waterfall plots which shows the resultant spectral data and illustrates the swashplate vibrations of a standard hydraulic unit, such as a Sauer-Sundstrand Series 45 Open Circuit Pump with 57 cc displacement, that is not equipped with the attenuator or oscillator means of this invention. FIG. 2A shows the frequency in hertz on the x or horizontal axis versus the acceleration amplitude in g's of the vibrations on the y or vertical axis when the pump is run at 2800 rpm. FIG. 2 incorporates the variable of pump speed in rpm's on the z axis to make the plot three dimensional. FIG. 2 includes data for 501 to 3001 rpm's traced at 100 rpm intervals which ascend from the forefront (bottom) to background (top) of the graph.

A very large resonance with accelerations in excess of 100 g's can be seen at the first piston harmonic above 2600 rpm and in the neighborhood of 450 hertz. Higher frequencies and harmonics are also seen to be excited in this speed range. Vibration levels of this magnitude are very deleterious to the pumping components and mechanisms. They also manifest themselves in higher amplitudes in the unsteady portion of the outlet pressure and thus are detrimental to other hydraulic components as well. Increases in structural borne, fluid borne and airborne noise levels are also evident.

Figure 3:
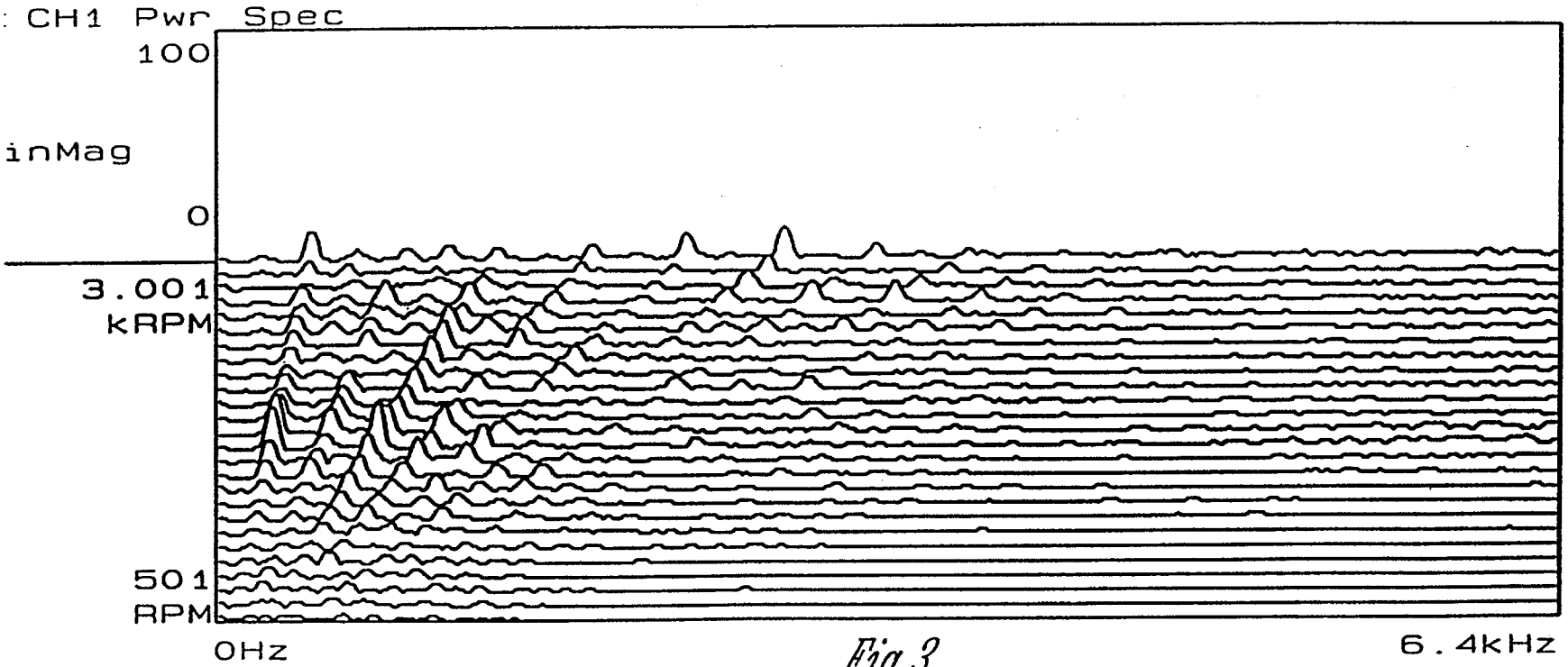
FIG. 3 is a plot similar to FIG. 2 except showing the swashplate vibrations in the same open-circuit axial piston hydraulic pump after it is equipped with the attenuator of the present invention according to FIG. 1.
Figure 3A:
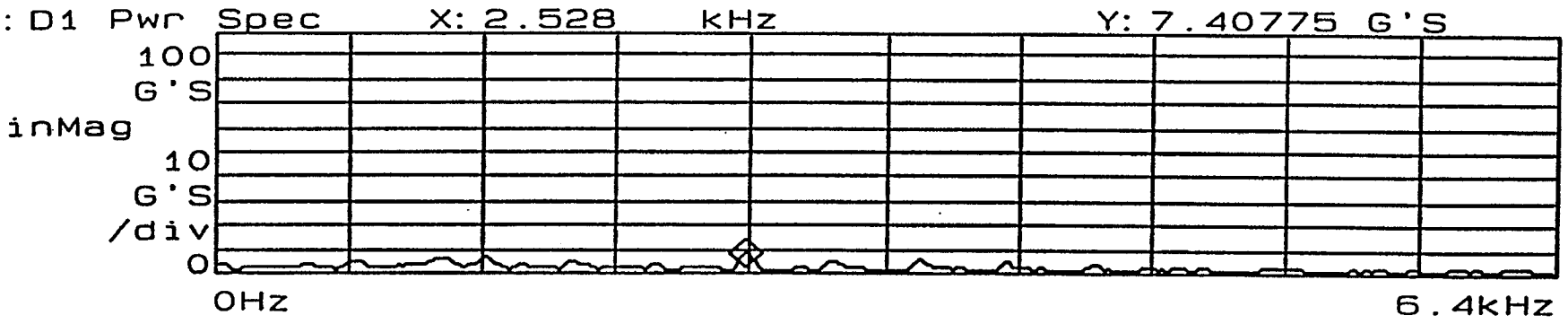
FIG. 3A corresponds to FIG. 3 and is a plot which shows the frequency in hertz versus the acceleration amplitude in g's of the vibrations when the pump is run at 2800 rpm.

FIG. 3 and 3A are a set of waterfall plots similar to FIG. 2, except they show the spectral data for a Sauer-Sundstrand Series 45 57 cc Open Circuit Pump equipped with the attenuator or oscillator means 50 of the present invention. The oscillator means 50 includes a rigid tube having an internal diameter of 0.15 inch and a length L2 of 5.7 inches constitutes the inertial pipe portion 52. A 7.0 inch length L3 (plus the fittings required to close one end and join the other end to the pipe portion 52) of #8 (internal diameter D3=13/32 or 0.406 inch) hydraulic hose having an internal volume V3 of 1.0 cubic inch serves as the compliant or hydraulic spring portion 54 of the oscillator means 50.

When FIGS. 2 and 3 are compared, it is apparent that the magnitude of the swashplate vibrations has been significantly reduced by the oscillator means 50. For instance, the amplitude of the swashplate vibrations has been reduced from over 120 g's to less than 10 g's. All of the harmonics and higher frequencies that were excited in the unattenuated pump at rpm's of 1200 or more have also subsided.

Figure 7:
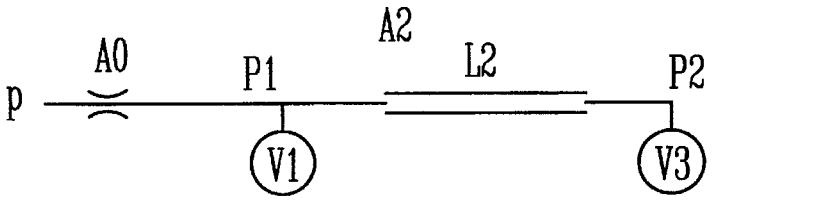
FIG. 7 is a simplified hydraulic schematic depicting the linearized model developed herein and representing the portion of the circuit surrounding the servo piston in FIG. 1.

The present invention includes the development of a mathematical model to predict the dynamic response relating P1 and P for a hydraulic unit when various system parameters are changed. Although a comprehensive dynamic model could be developed for the entire system, a simple linearized dynamic model in the area of interest is adequate to describe the function of the oscillator when used on the hydraulic unit. FIG. 7 shows the simplified circuit used to develop the model. Formula (1) is the main formula and predicts P1/P. Translational formulas (a)–(e) relate the various input parameters, estimates and assumptions to the variables in Formula (1). One skilled in the art will recognize that these formula can be used to tune the oscillator, that is, size its components to achieve the desired attenuation.

MAIN LINEARIZED MODEL FORMULA $$\frac{P_1}{P} = \frac{1}{1 + \dfrac{\tau_2 s}{1 + \dfrac{2\zeta}{\omega_2} s + \left[\dfrac{s}{\omega_2}\right]^2} + \tau_1 s}$$

TRANSLATIONAL FORMULAS (a) $K_o = \dfrac{50A_0}{[Pnom]^{1/2}}$ (b) $\tau_1 = \dfrac{V_1}{\beta K_o}$ (c) $\tau_2 = \dfrac{V_3}{\beta K_o}$ (d) $\omega_2 = \left[\dfrac{\beta A_2}{\rho L_2 V_3}\right]^{1/2}$ (e) For a cylindrical hose $V_3 = L_3 A_3 = L_3 \pi D_3^2/4$ The variables appearing in the equations above are defined below:

| | |
|---|---|
| P | is the output or supply pressure in pounds per square inch (psi); |
| $P_1$ | is the servo pressure in psi |
| β(beta) | is the bulk modulus of the oil in psi; |
| ρ(rho) | is the density of the oil in pounds force times seconds over inches to the fourth power (lbf-s/in$^4$); |
| $A_0$ or AO | is the area in square inches of an orifice equivalent to the restriction of the main stage valve 32 (this value is amplitude dependent); |
| Pnom | is the mean pressure drop in psi across the main stage valve 32; |
| $K_o$ | is the linearized flow coefficient for the orifice AO or $A_0$ in inches to the fifth power over pounds force squared (in$^5$/lbf-sec); |
| $V_1$ or V1 | is the operative volume in cubic inches of the servo piston cylinder or bore; |
| $\tau_1$(tau one) | is the servo time constant in seconds; |
| $L_3$ or L3 | is the length in inches of the compliant portion or hose; |
| $D_3$ or D3 | is the diameter in inches of the hose; |
| $A_3$ or A3 | is the area in square inches of the hose; |
| $V_3$ or V3 | is the volume in cubic inches of the hose; |
| $\tau_2$(tau two) | is the time constant in seconds related to the hose: |
| $D_2$ or D2 | is the diameter in inches of the inertial pipe; |
| $A_2$ or A2 | is the area in square inches of the pipe; |
| $L_2$ or L2 | is the length in inches of the pipe; |
| $\omega_2$(omega two) | is the oscillator frequency in radians per second; |
| $freq_2$ | is the oscillator frequency in hertz, (freq2 = $\omega_2/2\pi$); |
| $\zeta_2$(zeta) | is the estimated damping ratio and has no units; and |
| s | is the Laplace transformation operator in units of sec$^{-1}$. |

Figure 4:
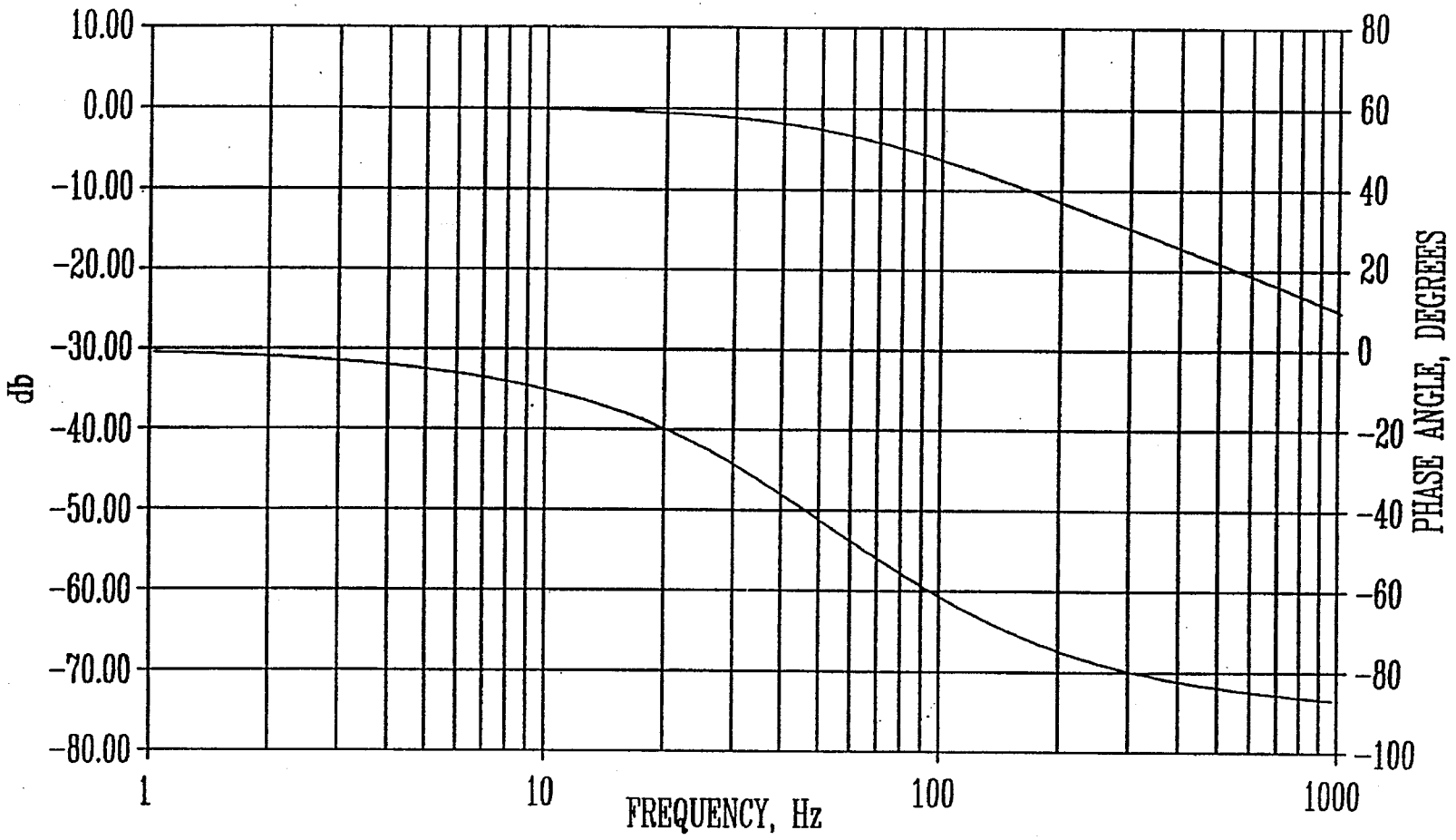
FIG. 4 is a graph known as a Bode plot wherein the mathematical model described below is used to depict the expected dynamic response of the relation of the servo pressure P1 to supply pressure P in a standard hydraulic unit before it is equipped with the attenuator of the present invention.

For the previously mentioned pump without the oscillator the pertinent variables were measured or estimated as follows: β=200,000 psi; ρ=8.0×10$^{-5}$ lbf–s/in$^4$; AO=0.00288 in$^2$; $K_0$=0.002629 in$^5$/lbf–s; V1=1.2 in$^3$; and $\tau_1$=0.002282 sec. Since no oscillator is present $\tau_2$=0. Therefore, the middle term in the denominator of the main formula drops out and the formula reduces to a first order lag equation: P1/P=1/(1+$\tau_1$s). FIG. 4 shows the predicted dynamic response relating servo pressure P1 and supply pressure P for the pump without the oscillator elements. This type of representation of dynamic data is known as a Bode plot (also referred to as frequency response data). The Bode plot shows the signal gain characteristic in db and the phase relationship in degrees; both as a function of frequency. The lower curve plots the frequency in hertz versus the phase relationship in degrees which is shown on the vertical axis on the right. The upper curve plots the frequency in hertz versus the signal gain characteristic in db [20 $\log_{10}$(P1/P)] which is shown on the vertical axis on the left. The Bode plot representation itself is well known to those skilled in the art. The response shown on FIG. 4 is typical of a first order lag. At 450 hertz we see that the signal has been attenuated slightly less than 20 db but phase lag of over 80 degrees is also evident.

As the amplification effect of the complete closed loop system nears or exceeds zero db with a phase lag approaching 180 degrees, we would expect to see a resonance as seen on FIG. 2. We would expect the resonance to subside if we can appreciably reduce the phase lag or increase the signal attenuation.

Figure 5:
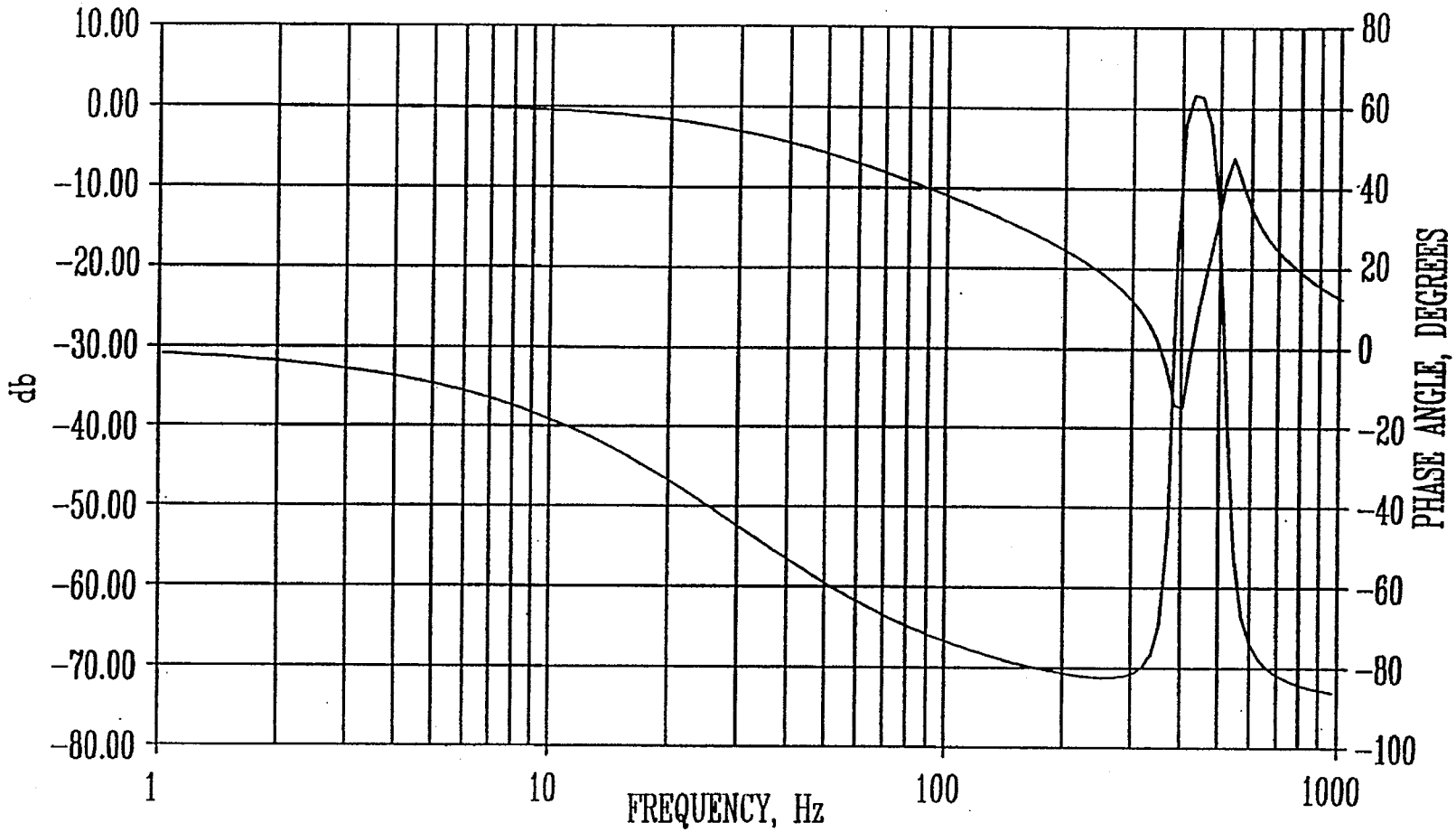
FIG. 5 is a graph similar to FIG. 4, but shows the model predicted or expected results when a hydraulic unit is equipped with the attenuator of the present invention.

Using the formulas discussed above we can tune an oscillator or size its components for a particular hydraulic unit that has a known troublesome frequency. The previously mentioned pump has a troublesome frequency of about 450 hertz. Therefore, if a hose 54 having a volume V3 of 1.0 in.$^3$, and a hose time constant $\tau_2$=0.001902 is selected and used in conjunction with a pipe 52 having a diameter D2 of 0.15 in., an area A2 of 0.017671 in.$^2$, and a length L2 of 5.7 in., swashplate oscillations should be attenuated. FIG. 5 shows the dynamic response relating pressure P1 and P for the pump with the oscillator means 50 sized or tuned as described above. As can be seen, a tremendous phase lead has been introduced at the troublesome frequency (450 hertz); from −80 degrees to over +60 degrees (an increase or phase lead of over 140 degrees). This brings the phase relationship back into a non-resonant condition for the system at the known troublesome frequency.

The device disclosed herein solves the vibration problem in a simple yet elegant way. The present invention provides an apparatus and method for attenuating vibrations at a known troublesome frequency in a hydraulic unit. The method comprises connecting the tuned oscillator means 50 to the servo cylinder 24, allowing the fluid to enter the inertial portion 52 and then the hydraulic spring portion 54, and compressing the fluid to introduce a phase change which is transmitted back through the servo piston assembly 20 and thereby to the swashplate 12. Thus, swashplate vibrations are attenuated.

Figure 6:
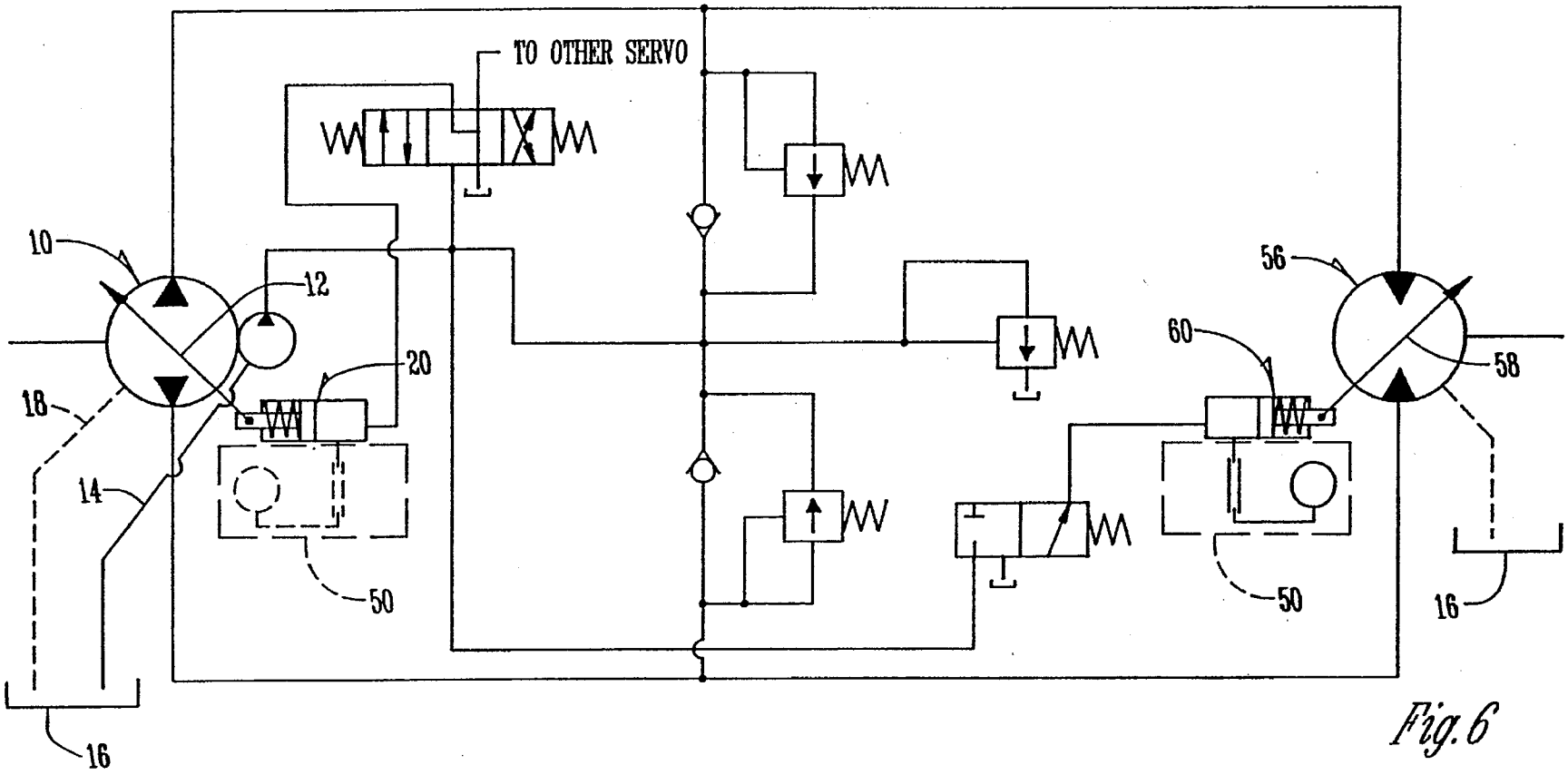
FIG. 6 is a hydraulic schematic of a closed circuit variable pump and motor system equipped with the attenuator of this invention.

FIG. 6 illustrates how the attenuator or oscillator means 50 of the present invention can be applied in a closed circuit to either a variable pump 10 having a swashplate 12 and a servo mechanism 20 or a variable motor 56 having a movable swashplate 58 and a servo mechanism 60. The basic closed circuit shown is well known and will not be further described in detail herein. However, the oscillator means 50 is installed on one of the servo mechanisms 20 or 60. The inertial pipe portion 52 is connected fluidly, and preferably mechanically, to the servo mechanism 20. The compliant portion 54 is connected to the inertial pipe portion 52 as described above. Thus, swashplate dithering and vibration can be reduced in closed circuit applications as well.

Whereas the invention has been shown and described in connection with the preferred embodiment thereof, it will be understood that modifications, substitutions, and additions may be made which are within the intended broad scope of the following claims. From the foregoing, it can be seen that the present invention accomplishes at least all of the stated objectives.

What is claimed is:

1. A method of attenuating vibration and pressure within a a hydraulic unit having a swashplate therein connected to a servo piston disposed in a servo piston cylinder bore fluidly connected to the hydraulic unit, the hydraulic unit displacing pressurized fluid having a periodic component therein exerted at a troublesome frequency on the fluid in the servo piston cylinder bore due to vibrational movement of the swashplate, the method comprising:

connecting the servo piston cylinder bore to an oscillator tuned to the troublesome frequency, the oscillator having a substantially rigid inertial portion and a hydraulic spring portion fluidly connected to the inertial portion;

allowing pressurized fluid to enter the inertial portion and thence enter into the hydraulic spring portion;

compressing the pressurized fluid in the hydraulic spring portion to cause a phase change of the periodic component and introduce a phase shifted second periodic component into the pressurized fluid in the hydraulic spring portion whereby the second periodic component will transfer back through the pressurized fluid in the inertial portion to the servo piston cylinder bore whereupon the servo piston will transmit the second periodic component to the swashplate to attenuate the vibrational movement thereof.

2. A vibration and pressure attenuator for a variable displacement hydraulic unit having a movable displacement varying means whose vibration causes an outlet pressure to have a periodic component, the attenuator comprising:

a servo mechanism connected to the movable displacement varying means for changing the displacement of the variable displacement hydraulic unit and fluidly connected to the outlet pressure;

an oscillator means having an inertial pipe portion having a fixed length and inside diameter and one end fluidly connected to the servo mechanism and another end connected to a hydraulic spring portion having an internal volume for fluid whereby the oscillator means attenuates vibration and the periodic component of the pressure in the hydraulic unit.

3. The attenuator of claim 2 wherein the hydraulic unit is an open circuit pump.

4. The attenuator of claim 2 wherein the hydraulic unit is a closed circuit variable motor.

5. The attenuator of claim 2 wherein the movable displacement varying means comprises a swashplate tiltable about an axis.

6. The attenuator of claim 2 wherein the hydraulic unit has a plurality of reciprocative axial pistons for receiving and displacing fluid.

7. The attenuator of claim 2 wherein the inertial pipe portion has a length-over-diameter ratio L/D greater than twenty.

8. The attenuator of claim 2 wherein the inertial pipe portion has a length-over-diameter ratio L/D of approximately thirty-eight.

9. The attenuator of claim 2 wherein the inertial pipe portion is connected to the servo mechanism and interposed between the servo mechanism and the hydraulic spring portion.

10. The attenuator of claim 2 wherein the servo mechanism comprises a cylinder having opposite ends, a piston disposed in the cylinder, and a spring positioned with respect to the cylinder and the piston so as to urge the piston toward one of the ends of the cylinder, the inertial pipe portion of the oscillator means being connected to and in fluid communication with the end of the cylinder toward which the spring urges the piston.

11. The attenuator of claim 2 wherein the hydraulic spring portion has a closed end opposite the inertial pipe portion.

12. The attenuator of claim 2 wherein the hydraulic spring portion is a hose having an inside diameter that is larger than the inside diameter of the inertial pipe portion.

* * * * *

UNITED STATES PATENT AND TRADEMARK OFFICE

CERTIFICATE OF CORRECTION

PATENT NO. : 5,588,805
DATED : December 31, 1996
INVENTOR(S) : Kerry G. Geringer It is certified that error appears in the above-indentified patent and that said Letters Patent is hereby corrected as shown below:

The title page, showing an illustrative figure, should be deleted and substitute therefor the attached title page.

Delete Drawing Sheet 1 of 8, and substitute therefor the Drawing Sheet 1 of 8, consisting of Figs. 1 and 7, as shown on the attached pages.

United States Patent [19]

Geringer

[11] Patent Number: 5,588,805

[45] Date of Patent: Dec. 31, 1996

[54] VIBRATION AND PRESSURE ATTENUATOR FOR HYDRAULIC UNITS

[75] Inventor: Kerry G. Geringer, Ames, Iowa

[73] Assignee: Sauer Inc., Ames, Iowa

[21] Appl. No.: 520,083

[22] Filed: Aug. 28, 1995

[51] Int. Cl.[6] ..... F04B 1/26

[52] U.S. Cl. ..... 417/53; 417/222.1

[58] Field of Search ..... 417/218, 222.1, 417/53; 60/469

[56] References Cited

U.S. PATENT DOCUMENTS

| | | | |
|---|---|---|---|
| 3,612,724 | 10/1971 | Smith | 417/222 |
| 3,826,593 | 7/1974 | Von Casimir | 417/53 |
| 4,234,292 | 11/1980 | Berg | 417/218 |
| 4,456,434 | 6/1984 | El Ibiary | 417/218 |
| 4,734,011 | 3/1988 | Hall, Jr. | 417/2 |
| 5,475,976 | 12/1995 | Phillips | 60/469 |

*Primary Examiner*—Timothy S. Thorpe
*Assistant Examiner*—Peter G. Korytnyk
*Attorney, Agent, or Firm*—Zarley, McKee, Thomte, Voorhees, & Sease

[57] ABSTRACT

An attenuator for a variable displacement hydraulic unit having a servo connected to a swashplate includes an oscillator connected to the servo. The oscillator includes a pipe constituting an inertial portion connected to the servo and a hose defining a hydraulic spring portion connected the other end of the pipe. The pipe has a fixed length and diameter. The pipe and hose combine to attenuate vibration and output pressure in the hydraulic unit by introducing a phase change in the pressure fluctuations within the fluid. A linearized model assists in sizing the components and tuning the oscillator to the troublesome frequency of the hydraulic unit. A method for using the oscillator to attenuate periodic pressure fluctuations due to swashplate vibrations includes fluidly connecting the oscillator to the servo piston bore and introducing a phase change to the periodic component of the fluid pressure by routing the fluid through the oscillator then returning it to the servo piston bore.

12 Claims, 8 Drawing Sheets

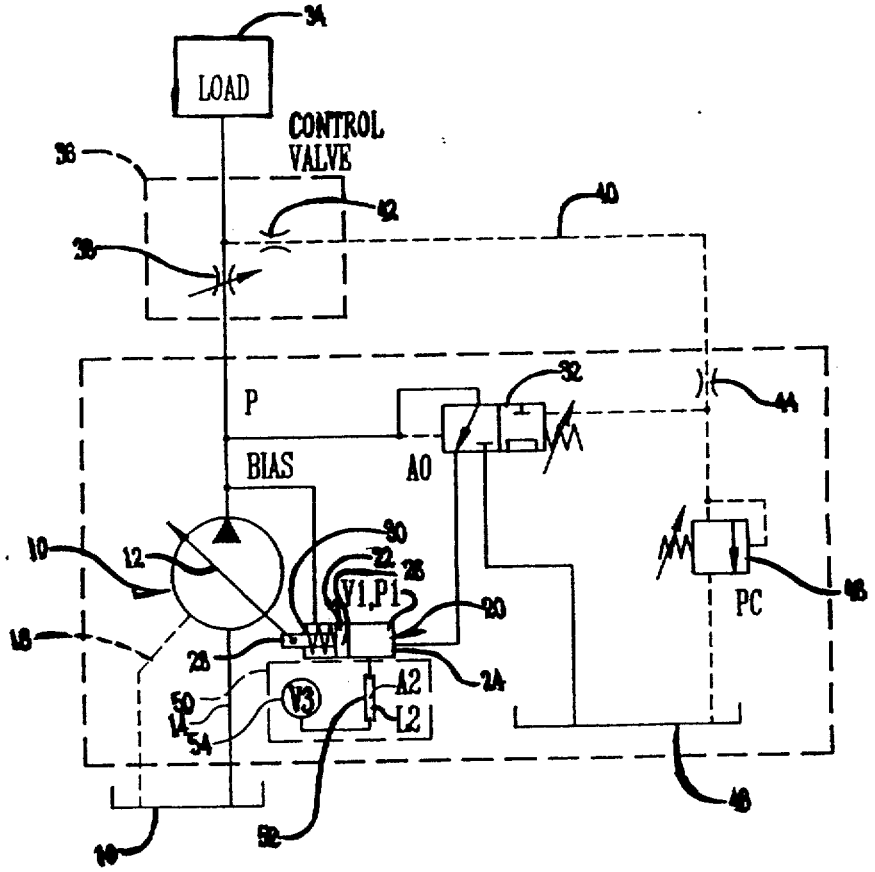

UNITED STATES PATENT AND TRADEMARK OFFICE

CERTIFICATE OF CORRECTION

PATENT NO. : 5,588,805

DATED : December 31, 1996

INVENTOR(S) : Kerry G. Geringer

It is certified that error appears in the above-indentified patent and that said Letters Patent is hereby corrected as shown below:

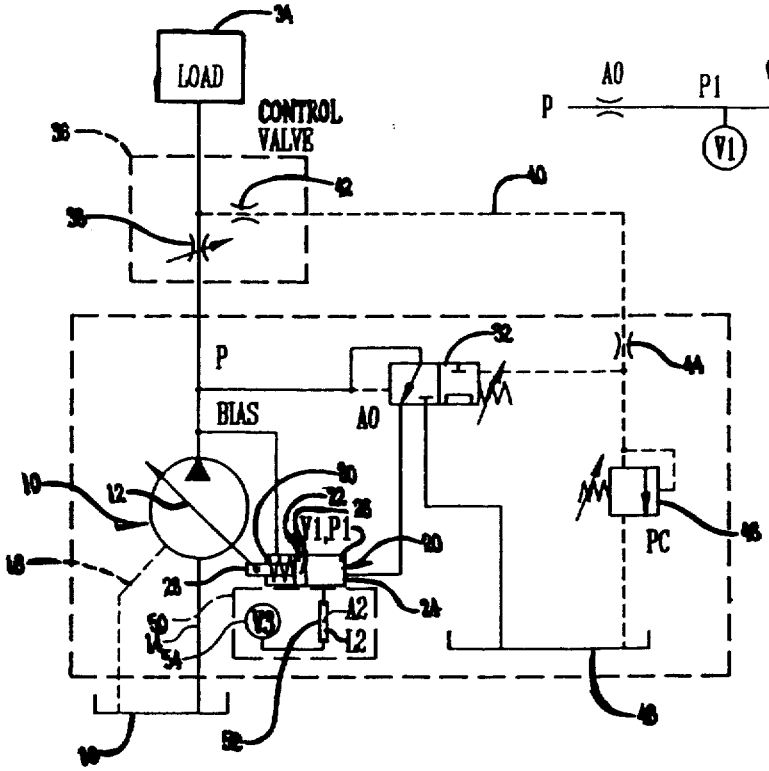

Fig. 1

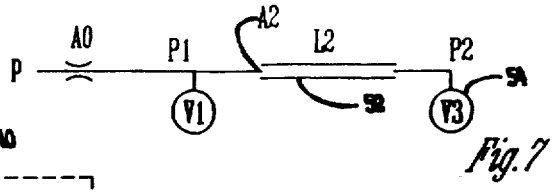

Fig. 7

UNITED STATES PATENT AND TRADEMARK OFFICE

CERTIFICATE OF CORRECTION

PATENT NO. : 5,588,805

DATED : December 31, 1996

INVENTOR(S) : Kerry G. GERINGER

It is certified that error appears in the above-identified patent and that said Letters Patent is hereby corrected as shown below:

In column 5, lines 45-49, please delete:

"MAIN LINEARIZED MODEL FORMULA $$\frac{P_1}{P} = \frac{1}{1 + \frac{\tau_2 s}{1 + \frac{2\zeta}{\omega_2} s + \left[\frac{s}{\omega_2}\right]^2} + \tau_1 s}$$

"

and substitute --

MAIN LINEARIZED MODEL FORMULA $$(1) \qquad \frac{P_1}{P} = \frac{1}{1 + \frac{\tau_2 s}{1 + 2\zeta\left[\frac{s}{\omega_2}\right] + \left[\frac{s}{\omega_2}\right]^2} + \tau_1 s}$$

--.

UNITED STATES PATENT AND TRADEMARK OFFICE

CERTIFICATE OF CORRECTION

PATENT NO. : 5,588,805

DATED : December 31, 1996

INVENTOR(S) : Kerry G. GERINGER

It is certified that error appears in the above-identified patent and that said Letters Patent is hereby corrected as shown below:

In column 5, lines 52-53, please delete:

" (a) $K_O = \dfrac{50A_0}{[\overline{\text{Pnom}}]^{\frac{1}{2}}}$ "

and substitute --

(a) $K_0 = \dfrac{C_0 A_0}{[2\rho Pnom]^{1/2}}$

Generally, for oil, $\rho = 8x10^{-5}(1bf\sec)/in^4$ and $C_D = .63$. Therefore, $K_0 = \dfrac{50A_0}{[Pnom]^{1/2}}$ --.

In column 6, line 10, please delete "squared" and substitute --second--.

In column 7, lines 43-44, (claim 12) please delete "within a" and substitute --within--.

Signed and Sealed this

Fourteenth Day of July, 1998

Bruce Lehman

*Attest:*

BRUCE LEHMAN

*Attesting Officer*

*Commissioner of Patents and Trademarks*